US011177084B1

(12) United States Patent
Liu

(10) Patent No.: US 11,177,084 B1
(45) Date of Patent: Nov. 16, 2021

(54) KEY STRUCTURE

(71) Applicant: Primax Electronics Ltd., Taipei (TW)

(72) Inventor: Chien-Hung Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/108,404

(22) Filed: Dec. 1, 2020

(30) Foreign Application Priority Data

Oct. 16, 2020 (TW) ..... 109135993

(51) Int. Cl.
*H01H 3/12* (2006.01)
*H01H 13/702* (2006.01)

(52) U.S. Cl.
CPC ..... *H01H 3/125* (2013.01); *H01H 13/702* (2013.01); *H01H 2221/052* (2013.01)

(58) Field of Classification Search
CPC ..... H01H 3/125; H01H 13/702; H01H 13/14; H01H 13/20; H01H 2221/062; H01H 13/84
USPC ..... 200/5 A, 333, 341, 344, 345
See application file for complete search history.

(56) References Cited

U.S. PATENT DOCUMENTS

2018/0025862 A1* 1/2018 Chen ..... G06F 3/0202 200/5 A
2019/0287744 A1* 9/2019 Wu ..... G06F 3/0202

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A key structure includes a keycap, an elastic buffering element, a base plate, a first supporting element, a second supporting element and an elastomer. The elastic buffering element is installed in a locking part of the keycap. The first supporting element is connected with the keycap and the base plate. The keycap is movable upwardly or downwardly relative to the base plate through the first supporting element. A first end of the second supporting element is pivotally coupled to the base plate. A second end of the second supporting element is penetrated through a pivotal hole of the elastic buffering element and a clamping recess of the locking part. The elastomer is arranged between the keycap and the base plate. An inner diameter of the at least one pivotal hole is slightly smaller than an inner diameter of the clamping recess.

15 Claims, 8 Drawing Sheets

KEY STRUCTURE

FIELD OF THE INVENTION

The present invention relates to the field of an input device, and more particularly to a key structure.

BACKGROUND OF THE INVENTION

In modern societies, electronic products become indispensable parts in human lives. The electronic products are applied in many sectors, including food, clothing, housing, transportation, education and entertainment. Generally, the electronic product comprises a keyboard. For allowing the user to operate the keyboard flexibly, the key structure of the keyboard is usually equipped with a supporting element or a stabilizer bar to increase the overall structural strength of the key structure. The keycap of the key structure is movable upwardly or downwardly relative to a base plate. However, while the keycap is moved upwardly or downwardly, the supporting element or the stabilizer bar may readily rub against or collide with the keycap. Consequently, an unpleasant noise is generated.

As mentioned above, the noise is generated when the supporting element or the stabilizer bar rubs against or collides with the keycap. Conventionally, in order to reduce the noise, lubricating oil is usually applied to the coupling structure, or an interference structure for noise reduction is formed on the lower surface of the keycap to reduce the impact sound. However, although the lubricating oil is applied to the region between components, the supporting element or the stabilizer bar may rub against the keycap during rotation. Under this circumstance, high-frequency noise is generated. On the other hand, the interference structure for noise reduction may impair the tactile feel of pressing down the key structure.

Therefore, there is a need of providing a key structure with enhanced noise-reduction efficacy and satisfied tactile feel.

SUMMARY OF THE INVENTION

The present invention provides a key structure with enhanced noise-reduction efficacy and satisfied tactile feel.

In accordance with an aspect of the present invention, a key structure is provided. The key structure includes a keycap, an elastic buffering element, a base plate, a first supporting element, a second supporting element and an elastomer. At least one locking part is disposed on a bottom surface of the keycap. The at least one locking part includes a clamping recess. The elastic buffering element includes a pivotal pedestal with at least one pivotal hole. The elastic buffering element is installed in the at least one locking part. The at least one pivotal hole is aligned with the clamping recess. The first supporting element is connected with the keycap and the base plate. The keycap is movable upwardly or downwardly relative to the base plate through the first supporting element. A first end of the second supporting element is pivotally coupled to the base plate. A second end of the second supporting element is penetrated through the at least one pivotal hole and the clamping recess. The elastomer is arranged between the keycap and the base plate. The elastomer is permitted to provide an elastic restoring force to the keycap. An inner diameter of the at least one pivotal hole is slightly smaller than an inner diameter of the clamping recess.

In an embodiment, the key structure further includes a membrane circuit board with a membrane switch. The membrane circuit board is located over the base plate, and the elastomer is located over the membrane switch.

In an embodiment, the elastic buffering element has a first surface and a second surface, which are opposed to each other. The second surface of the elastic buffering element is attached on the bottom surface of the keycap, so that the elastic buffering element is combined with the keycap.

In an embodiment, the pivotal pedestal includes a first pivotal part, a second pivotal part and a hollow part. The first pivotal part and the second pivotal part are aligned with each other. The hollow part is arranged between the first pivotal part and the second pivotal part. The at least one locking part is installed in the hollow part.

In an embodiment, the first pivotal part has a first pivotal hole, and the second pivotal part has a second pivotal hole. The first pivotal hole and the second pivotal hole are respectively located beside a first side and a second side of the clamping recess. The first pivotal hole and the second pivotal hole are aligned with the clamping recess. A first open part of the first pivotal hole and a second open part of the second pivotal hole are both located at the first surface.

In an embodiment, the elastic buffering element further includes a buffering pad. The buffering pad is disposed on a side of the first pivotal part and located near the second surface of the elastic buffering element. The buffering pad is aligned with the first pivotal hole.

In an embodiment, the elastic buffering element further includes an L-shaped groove, and the L-shaped groove is formed in the first surface of the elastic buffering element. A first end of the L-shaped groove is connected with the second pivotal hole. A second end of the L-shaped groove is an open end.

In an embodiment, the second supporting element includes a transverse bar and two branch bars. The two branch bars are respectively located at two ends of the transverse bar and perpendicular to the transverse bar. Each branch bar is connected with the transverse bar through a corresponding first bent segment.

In an embodiment, the transverse bar is pressed into the first pivotal hole and the second pivotal hole through the first open part and the second open part, so that a portion of the transverse bar is inserted into the first pivotal part, the locking part and the second pivotal part. The transverse bar is rotatable relative to the pivotal pedestal and the at least one locking part.

In an embodiment, while the keycap is pressed down in response to an external force, the transverse bar is rotated relative to the pivotal pedestal and the at least one locking part, and the first bent segment and a portion of the branch bar are inserted into the L-shaped groove and contacted with a bottom of the L-shaped groove.

In an embodiment, a distant end of each branch bar includes a second bent segment. The second bent segment is in parallel with the transverse bar and connected with the base plate.

In an embodiment, at least two coupling structures are protruded upwardly from the base plate and opposed to each other. Each coupling structure has a perforation. The second bent segment is penetrated through the corresponding perforation, so that the second supporting element is swingable relative to the base plate.

In an embodiment, the first supporting element includes a first frame and a second frame, and the first frame and the second frame are pivotally coupled to each other. A first end of the first frame is connected with the base plate. A second end of the first frame is connected with the keycap. A first end of the second frame is connected with the base plate. A second end of the second frame is connected with the keycap.

In an embodiment, a fixed hook and a movable hook are disposed on the bottom surface of the keycap. The fixed hook is pivotally coupled to the second end of the second frame. The movable hook is pivotally coupled to the second end of the first frame. The second end of the first frame is slidable within the movable hook.

In an embodiment, a first hook and a second hook are protruded upwardly from the base plate. The first hook is connected with the first end of the first frame. The second hook is connected with the first end of the second frame.

From the above descriptions, the present invention provides the key structure. The elastic buffering element is installed in the locking part. Due to the arrangement of the elastic buffering element, the rocking condition between the second supporting element and the keycap is reduced. In other words, the tiny collision sound caused from the rocking condition is reduced. Moreover, when the second supporting element is rotated, the high-frequency noise caused from the friction between the second supporting element and the bottom surface of the keycap is also attenuated. Since the elastic buffering element is also used as a buffering structure, the collision sound caused by the impact of the second supporting element on the bottom surface of the keycap will be reduced. Moreover, since the rocking condition between the second supporting element and the keycap is reduced, the keycap can be ascended or descended more stably while providing good tactile feel to the user.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
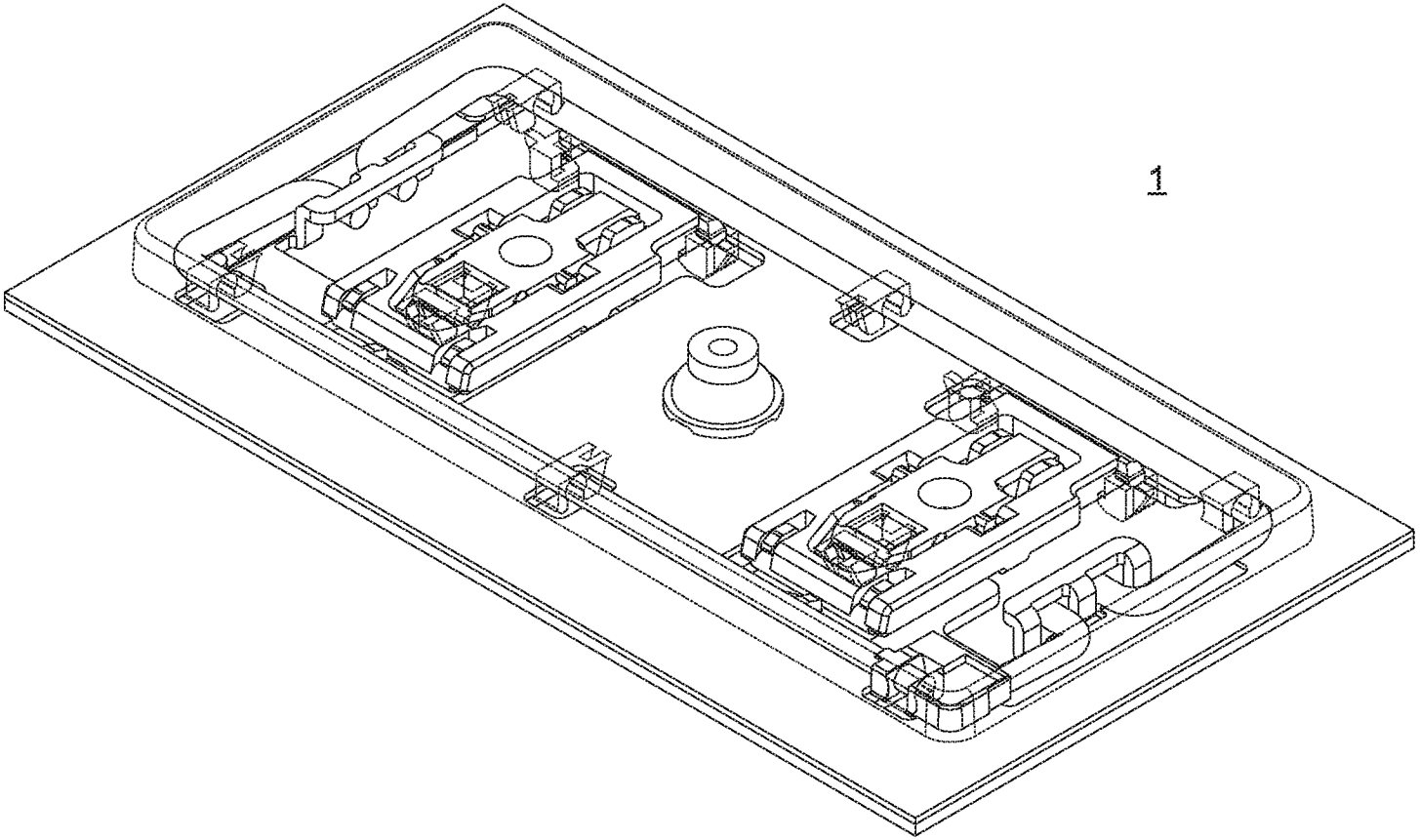
FIG. 1 is a schematic perspective view illustrating a key structure according to an embodiment of the present invention.
Figure 2A:
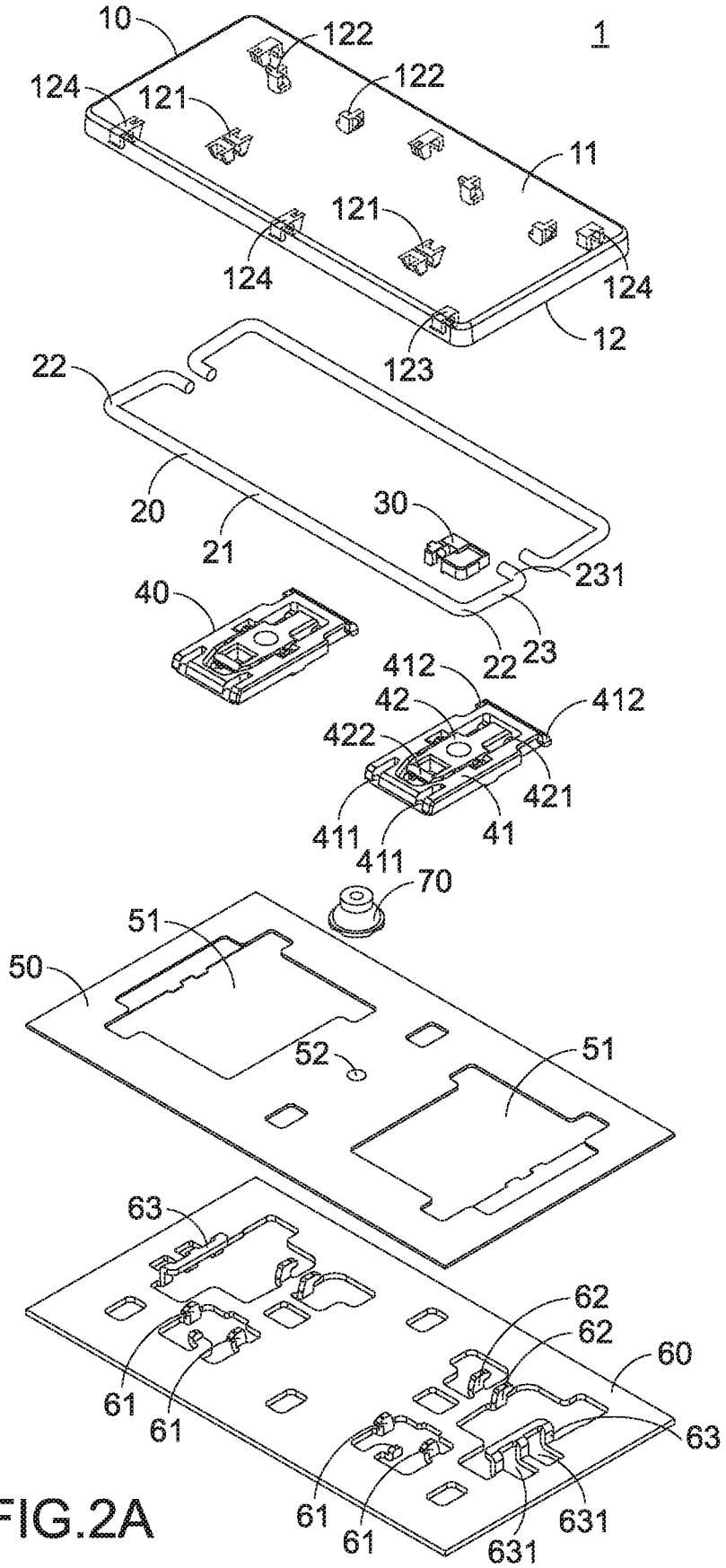
FIG. 2A is an exploded perspective view illustrating the key structure according to the embodiment of the present invention and taken along a viewpoint.
Figure 2B:
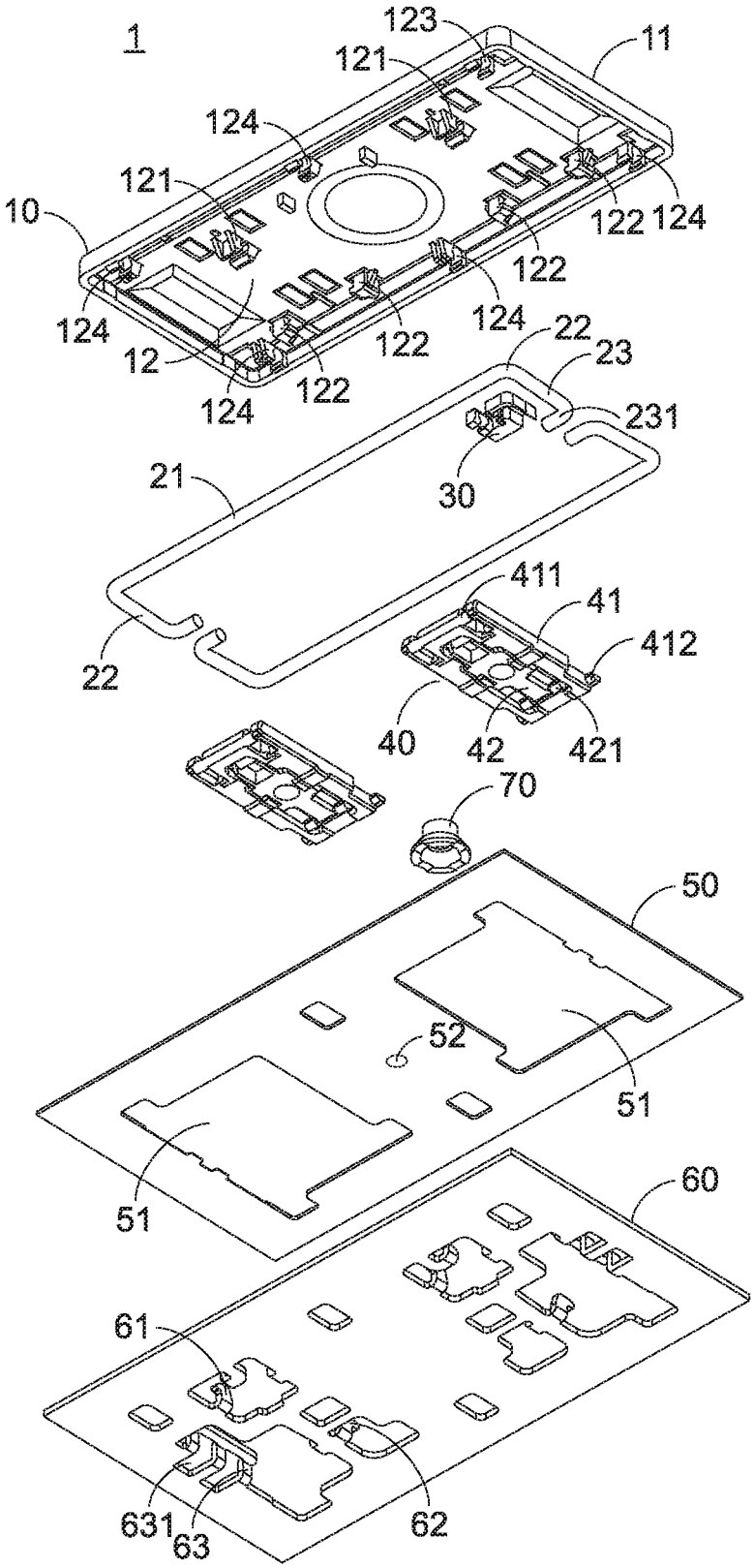
FIG. 2B is an exploded perspective view illustrating the key structure according to the embodiment of the present invention and taken along another viewpoint.

Please refer to FIGS. 1, 2A and 2B. FIG. 1 is a schematic perspective view illustrating a key structure according to an embodiment of the present invention. FIG. 2A is an exploded perspective view illustrating the key structure according to the embodiment of the present invention and taken along a viewpoint. FIG. 2B is an exploded perspective view illustrating the key structure according to the embodiment of the present invention and taken along another viewpoint. The key structure 1 comprises a keycap 10, at least one second supporting element 20, an elastic buffering element 30, at least one first supporting element 40, a membrane circuit board 50, a base plate 60 and an elastomer 70.

The keycap 10 has a top surface 11 and a bottom surface 12, which are opposed to each other. Moreover, plural fixed hooks 121 and plural movable hooks 122 are formed on the bottom surface 12 of the keycap 10. In an embodiment, the plural fixed hooks 121 and the plural movable hooks 122 are divided into two groups. Each group contains one fixed hook 121 and two movable hooks 122. Moreover, plural locking parts 123 and 124 are formed on the bottom surface 12 of the keycap 10 and located beside an inner side of a skirt structure of the keycap 10. The elastic buffering element 30 is installed in the locking part 123.

In an embodiment, the key structure 1 comprises two second supporting elements 20. Each second supporting element 20 is a linkage bar. The second supporting element 20 is used for facilitating the keycap 10 to be stably ascended or descended. In an embodiment, the second supporting element 20 has an inverted U-shaped structure. That is, the second supporting element 20 comprises a long transverse bar 21 and two branch bars 23. The two branch bars 23 are perpendicular to the transverse bar 21. The two ends of the transverse bar 21 are respectively connected with the two branch bars 23 through two first bent segments 22. The distant end of the branch bar 23 comprises a second bent segment 231. The second bent segment 231 is bent inwardly and in parallel with the transverse bar 21.

In an embodiment, the key structure 1 comprises two first supporting elements 40. Each first supporting element 40 is a scissors-type supporting element. The first supporting element 40 comprises a first frame 41 and a second frame 42. The first frame 41 and the second frame 42 are pivotally coupled to each other through a pivotal shaft. Consequently, the first frame 41 and the second frame 42 can be swung relative to each other. A first end 411 of the first frame 41 and a first end 421 of the second frame 42 are connected with the base plate 60. A second end 412 of the first frame 41 and a second end 422 of the second frame 42 are connected with the keycap 10. It is noted that the first supporting element 40 is not restricted to the scissors-type supporting element. That is, the example of the first supporting element 40 may be varied according to the practical requirements. For example, in another embodiment, the first supporting element 40 includes a V-shaped linkage, an A-shaped linkage or two parallel linkages. Alternatively, the first supporting element 40 is a keyboard bearing, including a MX blue switch, a MX brown switch, a MX red switch or a MX black switch.

The membrane circuit board 50 comprises two openings 51 and a membrane switch 52. The openings 51 run through the membrane circuit board 50. The membrane switch 52 is arranged between the two openings 51.

The elastomer 70 is arranged between the membrane circuit board 50 and the keycap 10. For example, the elastomer 70 is made of rubber, silicon or an elastic metallic material.

Moreover, plural first hooks 61, plural second hooks 62 and two coupling structures 63 are protruded upwardly from the base plate 60. In an embodiment, the plural first hooks 61 and the plural second hooks 62 are divided into two groups. Each group comprises two first hooks 61 and two second hooks 62. Each coupling structure 63 is located beside the corresponding first hooks 61 and the corresponding second hooks 62. The two coupling structures 63 are opposed to each other. Each coupling structure 63 comprises two perforations 631. It is noted that the number of perforations 631 of the coupling structure 63 of the base plate 61 is determined according to the number of the second supporting element 20. In case that key structure 1 is equipped with one second supporting element 20, each coupling structure 63 comprises one perforation 631.

Figure 3:
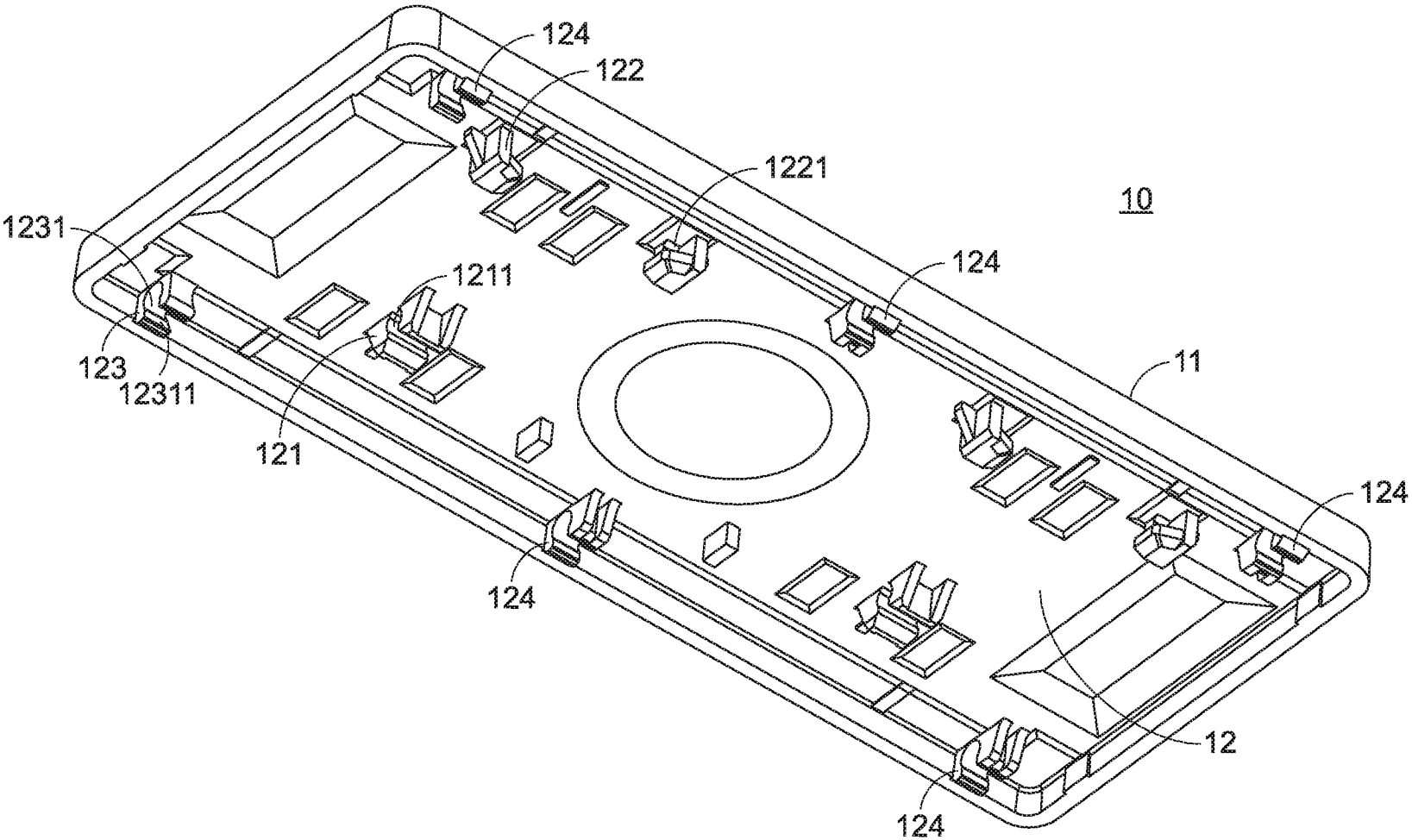
FIG. 3 is a schematic perspective view illustrating the keycap of the key structure according to the embodiment of the present invention and taken along a viewpoint.

Please refer to FIG. 3. FIG. 3 is a schematic perspective view illustrating the keycap of the key structure according to the embodiment of the present invention and taken along a viewpoint. As shown in FIG. 3, the plural fixed hooks 121 and the plural movable hooks 122 are formed on the bottom surface 12 of the keycap 10. The plural fixed hooks 121 and the plural movable hooks 122 are divided into two groups. Each group contains one fixed hook 121 and two movable hooks 122. Moreover, the plural locking parts 123 and 124 are formed on the bottom surface 12 of the keycap 10 and located beside the inner side of the skirt structure of the keycap 10. The fixed hook 121 comprises a pivotal hole 1211. The movable hook 122 comprises a sliding groove 1221. The locking part 123 is located at a corner of the keycap 10. The locking part 123 comprises a clamping recess 1231. The clamping recess 1231 has an open part 12311 that faces downwardly. Similarly, each of the locking parts 124 located beside the inner side of the skirt structure of the keycap 10 also comprises a clamping recess with a downward open part.

Figure 4A:
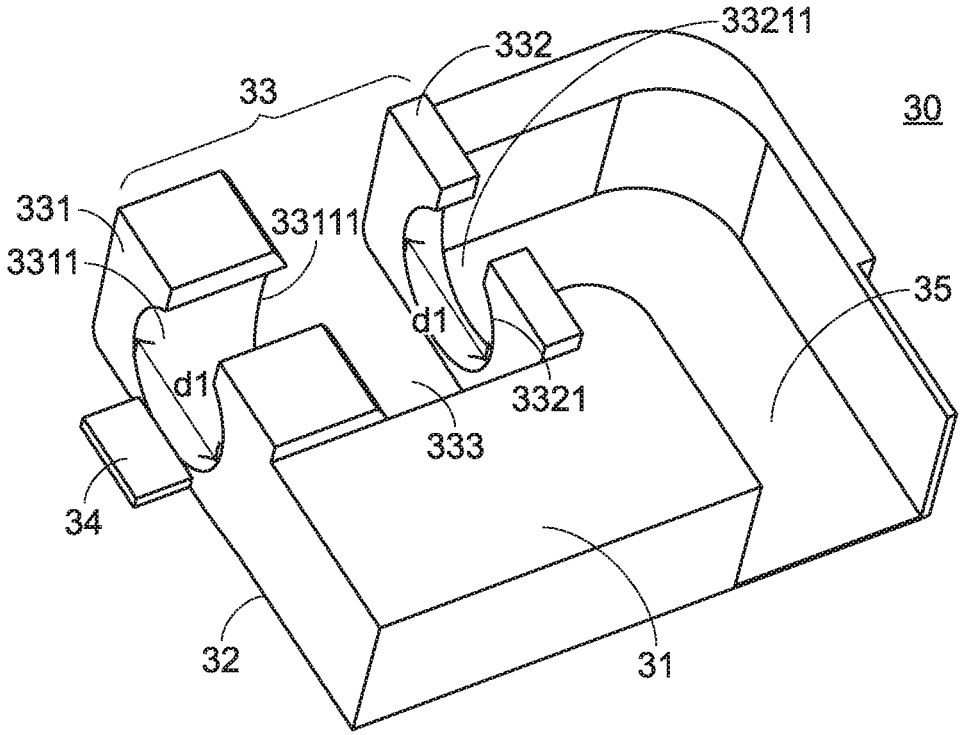
FIG. 4A is a schematic perspective view illustrating the elastic buffering element of the key structure according to the embodiment of the present invention and taken along a viewpoint.
Figure 4B:
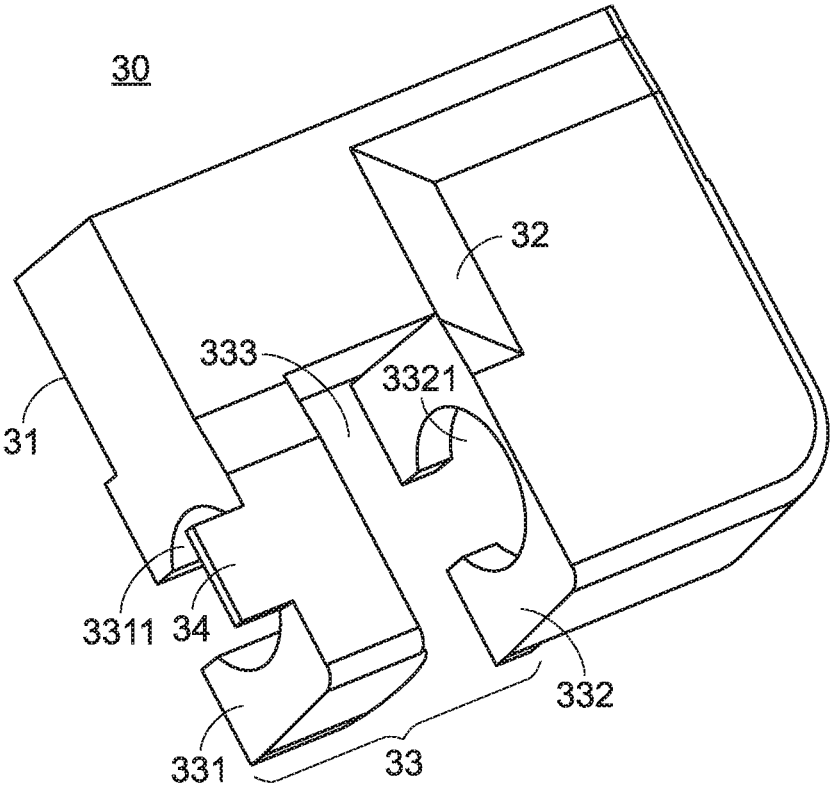
FIG. 4B is a schematic perspective view illustrating the elastic buffering element of the key structure according to the embodiment of the present invention and taken along another viewpoint.

Please refer to FIGS. 4A and 4B. FIG. 4A is a schematic perspective view illustrating the elastic buffering element of the key structure according to the embodiment of the present invention and taken along a viewpoint. FIG. 4B is a schematic perspective view illustrating the elastic buffering element of the key structure according to the embodiment of the present invention and taken along another viewpoint. The elastic buffering element 30 has a first surface 31 and a second surface 32, which are opposed to each other. In an embodiment, the elastic buffering element 30 comprises a pivotal pedestal 33, a buffering pad 34 and an L-shaped groove 35. The elastic buffering element 30 is made of a soft material, e.g., silicone. The pivotal pedestal 33 comprises a first pivotal part 331, a second pivotal part 332 and a hollow part 333. The first pivotal part 331 and the second pivotal part 332 are aligned with each other. The hollow part 333 is arranged between the first pivotal part 331 and the second pivotal part 332. The first pivotal part 331 has a first pivotal hole 3311. The second pivotal part 332 has a second pivotal hole 3321. The first pivotal hole 3311 and the second pivotal hole 3321 are aligned with each other. Each of the first pivotal hole 3311 and the second pivotal hole 3321 has an inner diameter d1. An open part 33111 of the first pivotal hole 3311 and an open part 33211 of the second pivotal hole 3321 are both located at the first surface 31.

The buffering pad 34 is disposed on a side of the first pivotal part 331 and located near the second surface 32 of the elastic buffering element 30. The buffering pad 34 is aligned with the first pivotal hole 3311. The buffering pad 34 is arranged along a linear line passing through the first pivotal hole 3311 and the second pivotal hole 3321. The L-shaped groove 35 is formed in the first surface 31 of the elastic buffering element 30. A first end of the L-shaped groove 35 is connected with the second pivotal hole 3321. A second end of the L-shaped groove 35 is an open end.

Figure 5:
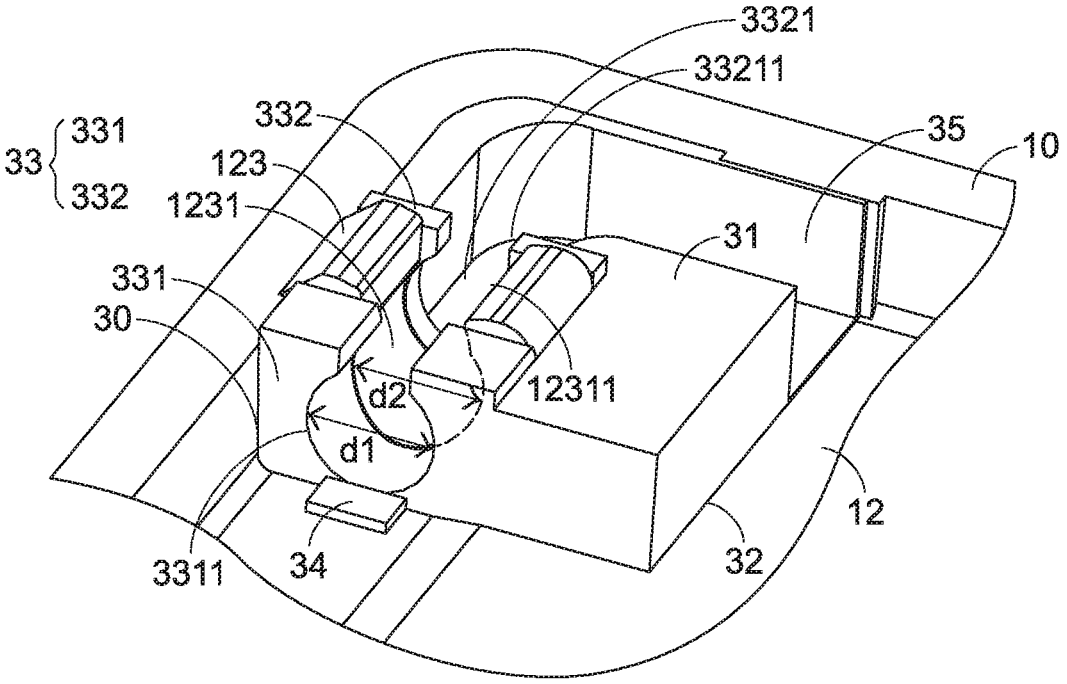
FIG. 5 is a schematic perspective view illustrating the installation of the elastic buffering element on the keycap of the key structure according to the embodiment of the present invention.

Please refer to FIGS. 3, 4A, 4B and 5. FIG. 5 is a schematic perspective view illustrating the installation of the elastic buffering element on the keycap of the key structure according to the embodiment of the present invention. As shown in FIG. 5, the elastic buffering element 30 is installed in the locking part 123 through an adhering means. For example, a bonding agent is coated on the second surface 32 of the elastic buffering element 30, and the second surface 32 of the elastic buffering element 30 is attached on the bottom surface 12 of the keycap 10 through the bonding agent. The locking part 123 is penetrated through the hollow part 333 of the pivotal pedestal 33 and disposed within the hollow part 333. In addition, the first pivotal hole 3311 and the second pivotal hole 3321 are located beside a first side and a second side of the clamping recess 1231 of the locking part 123, respectively. The first pivotal hole 3311 and the second pivotal hole 3321 are aligned with the clamping recess 1231 of the locking part 123.

In an embodiment, the inner diameter d1 of the first pivotal hole 3311 (and the second pivotal hole 3321) is slightly smaller than the inner diameter d2 of the clamping recess 1231 of the locking part 123. Moreover, the outer wall of the L-shaped groove 35 of the elastic buffering element 30 is attached on the corner of the skirt structure of the keycap 10.

In the above embodiment, the elastic buffering element 30 is installed in the locking part 123. It is noted that numerous modifications may be made while retaining the teachings of the invention. For example, in another embodiment, the elastic buffering element 30 is directly formed at the location of the locking part 123 through a double injection process while the keycap 10 is produced. Alternatively, the elastic buffering element 30 and the locking part 123 have the corresponding engaging structures, and the elastic buffering element 30 and the locking part 123 are combined together through the engaging structures.

A process of assembling the key structure 1 will be described with reference to FIGS. 2A, 2B, 3 and 5.

Firstly, the membrane circuit board 50 is disposed on the base plate 60. Meanwhile, the first hooks 61, the second hooks 62 and the coupling structures 63 are penetrated through the openings 51 and exposed to the openings 51. Then, the first hooks 61 are connected with the first ends 411 of the corresponding first frames 41, and the second hooks 62 are connected with the first ends 421 of the corresponding second frames 42. In addition, the fixed hooks 121 on the bottom surface 12 of the keycap 12 are pivotally coupled to the second ends 422 of the corresponding second frame 42, and the movable hooks 122 on the bottom surface 12 of the keycap 12 are pivotally coupled to the second ends 412 of the corresponding first frame 41. The second ends 412 of the first frame 41 are slidable within the sliding groove 1221.

The second bent segments 231 of the second supporting elements 20 are penetrated through the perforations 631 of the corresponding coupling structure 63. Consequently, the second supporting elements 20 can be swung relative to the base plate 60. The transverse bar 21 of the second supporting element 20 is penetrated through the locking parts 123, 124 and the pivotal pedestal 33 of the elastic buffering element 30. In this embodiment, the transverse bar 21 is pressed into the first pivotal hole 3311 and the second pivotal hole 3321 through the open parts 33111 and 33211. That is, the transverse bar 21 is inserted into the first pivotal part 331, the locking part 123 and the second pivotal part 332 sequentially. Consequently, the transverse bar 21 is rotatable relative to the pivotal pedestal 33 and the locking parts 123, 124.

The elastomer 70 is located over the membrane switch 52. A top side of the elastomer 70 is contacted with the bottom surface 12 of the keycap 10. As the keycap 10 is pressed down in response to an external force, the keycap 10 is moved downwardly to compress the elastomer 70, and the elastomer 70 is subjected to an elastic deformation to result a travel distance. Due to the elastic deformation, the elastomer 70 is contacted with the membrane switch 52. Consequently, the membrane switch 52 is triggered to generate a key signal. When the keycap 10 is no longer pressed, the keycap 10 is moved upwardly and returned to an original position in response to an upward elastic force of the elastomer 70.

Figure 6:
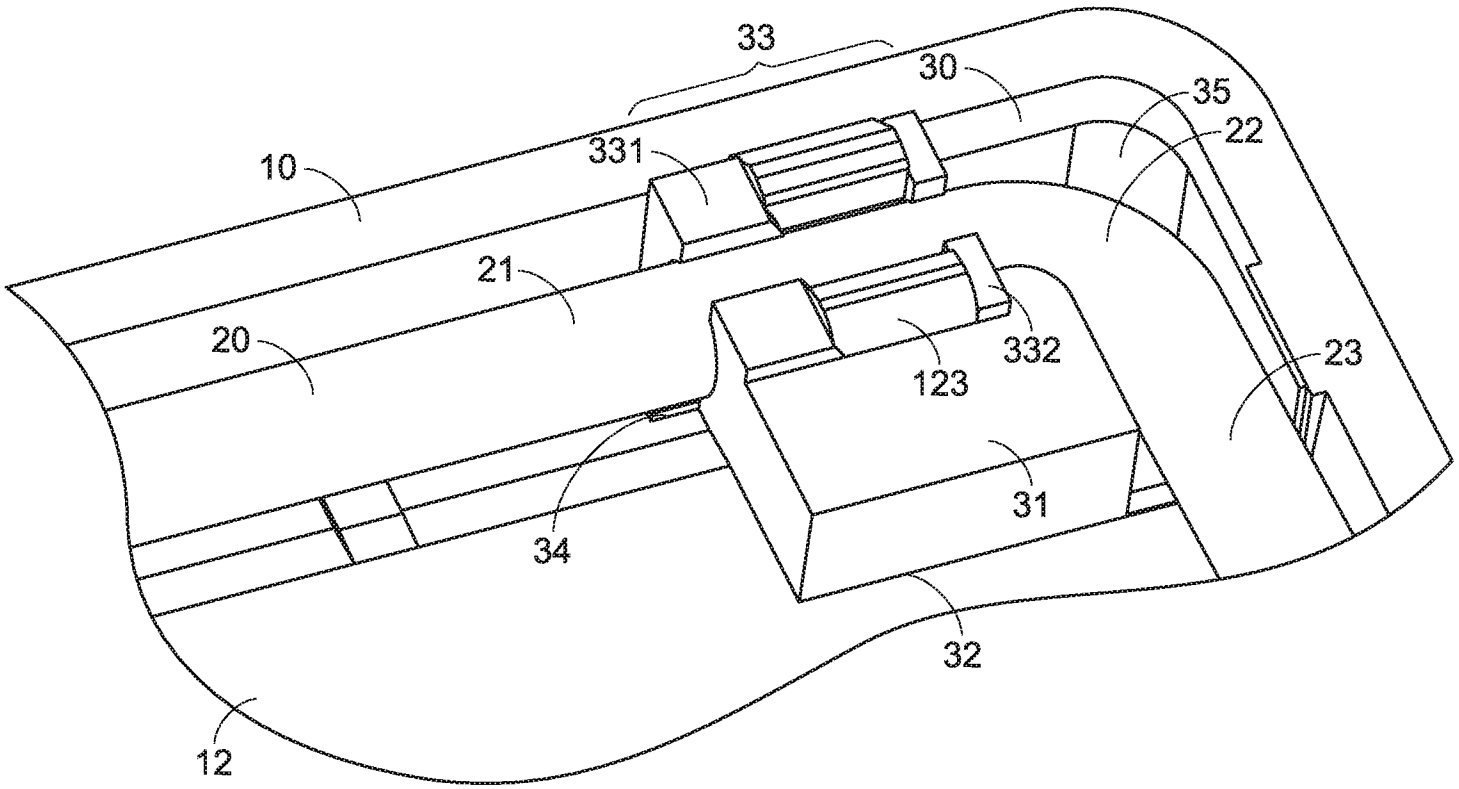
FIG. 6 schematically illustrates an action of the second supporting element of the key structure when the keycap is moved downwardly.

Please refer to FIG. 6. FIG. 6 schematically illustrates an action of the second supporting element of the key structure when the keycap is moved downwardly. As shown in FIG. 6, the transverse bar 21 of the second supporting element 20 is clamped by the first pivotal part 331 and the second pivotal part 332 of the pivotal pedestal 33 and the locking part 123 simultaneously. Since the inner diameter d1 of the first pivotal hole 3311 (and the second pivotal hole 3321) is slightly smaller than the inner diameter d2 of the clamping recess 1231 of the locking part 123 (see FIG. 5), the rocking condition between the second supporting element 20 and the keycap 10 is reduced. In other words, the tiny collision sound caused from the rocking condition is reduced. Moreover, the transverse bar 21 is contacted with the buffering pad 34. Consequently, when the transverse bar 21 is rotated, the high-frequency noise caused from the friction between the transverse bar 21 and the bottom surface 12 of the keycap 10 is also attenuated. Moreover, when the keycap 10 is pressed down to the lowest position in response to the external force, the first bent segment 22 of the second supporting element 20 and a portion of the branch bar 23 are inserted into the L-shaped groove 35 and contacted with the bottom of the L-shaped groove 35. Since the bottom of the L-shaped groove 35 is also used as a buffering structure, the collision sound caused by the impact of the second supporting element 20 on the bottom surface 12 of the keycap 10 will be reduced.

In the above embodiment, the elastic buffering element 30 is installed in the locking part 123 at the corner of the keycap 10. It is noted that numerous modifications may be made while retaining the teachings of the invention. For example, in another embodiment, the elastic buffering element 30 is not equipped with the L-shaped groove 35, and the elastic buffering element 30 is installed in one of the locking parts 124.

From the above descriptions, the present invention provides the key structure. The elastic buffering element is installed in the locking part. Due to the arrangement of the elastic buffering element, the rocking condition between the second supporting element and the keycap is reduced. In other words, the tiny collision sound caused from the rocking condition is reduced. Moreover, when the second supporting element is rotated, the high-frequency noise caused from the friction between the second supporting element and the bottom surface of the keycap is also attenuated. Since the elastic buffering element is also used as a buffering structure, the collision sound caused by the impact of the second supporting element on the bottom surface of the keycap will be reduced. Moreover, since the rocking condition between the second supporting element and the keycap is reduced, the keycap can be ascended or descended more stably while providing good tactile feel to the user. In other words, the key structure of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap, wherein at least one locking part is disposed on a bottom surface of the keycap, wherein the at least one locking part comprises a clamping recess;

an elastic buffering element comprising a pivotal pedestal with at least one pivotal hole, wherein the elastic buffering element is installed in the at least one locking part, and the at least one pivotal hole is aligned with the clamping recess;

a base plate;

a first supporting element connected with the keycap and the base plate, wherein the keycap is movable upwardly or downwardly relative to the base plate through the first supporting element;

a second supporting element, wherein a first end of the second supporting element is pivotally coupled to the base plate, and a second end of the second supporting element is penetrated through the at least one pivotal hole and the clamping recess; and an elastomer arranged between the keycap and the base plate, wherein the elastomer is permitted to provide an elastic restoring force to the keycap, wherein an inner diameter of the at least one pivotal hole is slightly smaller than an inner diameter of the clamping recess.

2. The key structure according to claim 1, wherein the key structure further comprises a membrane circuit board with a membrane switch, wherein the membrane circuit board is located over the base plate, and the elastomer is located over the membrane switch.

3. The key structure according to claim 1, wherein the elastic buffering element has a first surface and a second surface, which are opposed to each other, wherein the second surface of the elastic buffering element is attached on the bottom surface of the keycap, so that the elastic buffering element is combined with the keycap.

4. The key structure according to claim 3, wherein the pivotal pedestal comprises a first pivotal part, a second pivotal part and a hollow part, wherein the first pivotal part and the second pivotal part are aligned with each other, the hollow part is arranged between the first pivotal part and the second pivotal part, and the at least one locking part is installed in the hollow part.

5. The key structure according to claim 4, wherein the first pivotal part has a first pivotal hole, and the second pivotal part has a second pivotal hole, wherein the first pivotal hole and the second pivotal hole are respectively located beside a first side and a second side of the clamping recess, and the first pivotal hole and the second pivotal hole are aligned with the clamping recess, wherein a first open part of the first pivotal hole and a second open part of the second pivotal hole are both located at the first surface.

6. The key structure according to claim 5, wherein the elastic buffering element further comprises a buffering pad, wherein the buffering pad is disposed on a side of the first pivotal part and located near the second surface of the elastic buffering element, and the buffering pad is aligned with the first pivotal hole.

7. The key structure according to claim 5, wherein the elastic buffering element further comprises an L-shaped groove, and the L-shaped groove is formed in the first surface of the elastic buffering element, wherein a first end of the L-shaped groove is connected with the second pivotal hole, and a second end of the L-shaped groove is an open end.

8. The key structure according to claim 7, wherein the second supporting element comprises a transverse bar and two branch bars, wherein the two branch bars are respectively located at two ends of the transverse bar and perpendicular to the transverse bar, wherein each branch bar is connected with the transverse bar through a corresponding first bent segment.

9. The key structure according to claim 8, wherein the transverse bar is pressed into the first pivotal hole and the second pivotal hole through the first open part and the second open part, so that a portion of the transverse bar is inserted into the first pivotal part, the locking part and the second pivotal part, wherein the transverse bar is rotatable relative to the pivotal pedestal and the at least one locking part.

10. The key structure according to claim 9, wherein while the keycap is pressed down in response to an external force, the transverse bar is rotated relative to the pivotal pedestal and the at least one locking part, and the first bent segment and a portion of the branch bar are inserted into the L-shaped groove and contacted with a bottom of the L-shaped groove.

11. The key structure according to claim 8, wherein a distant end of each branch bar comprises a second bent segment, wherein the second bent segment is in parallel with the transverse bar and connected with the base plate.

12. The key structure according to claim 11, wherein at least two coupling structures are protruded upwardly from the base plate and opposed to each other, wherein each coupling structure has a perforation, and the second bent segment is penetrated through the corresponding perforation, so that the second supporting element is swingable relative to the base plate.

13. The key structure according to claim 1, wherein the first supporting element comprises a first frame and a second frame, and the first frame and the second frame are pivotally coupled to each other, wherein a first end of the first frame is connected with the base plate, a second end of the first frame is connected with the keycap, a first end of the second frame is connected with the base plate, and a second end of the second frame is connected with the keycap.

14. The key structure according to claim 13, wherein a fixed hook and a movable hook are disposed on the bottom surface of the keycap, wherein the fixed hook is pivotally coupled to the second end of the second frame, the movable hook is pivotally coupled to the second end of the first frame, and the second end of the first frame is slidable within the movable hook.

15. The key structure according to claim 13, wherein a first hook and a second hook are protruded upwardly from the base plate, wherein the first hook is connected with the first end of the first frame, and the second hook is connected with the first end of the second frame.

* * * * *